US011377261B2

(12) United States Patent
Lee et al.

(10) Patent No.: US 11,377,261 B2
(45) Date of Patent: Jul. 5, 2022

(54) TRAY FOR DISPLAY APPARATUS AND METHOD OF TRANSPORTING DISPLAY APPARATUS BY USING THE SAME

(71) Applicant: Samsung Display Co., Ltd., Yongin-Si (KR)

(72) Inventors: Sangwon Lee, Seongnam-si (KR); Jeong Ho Hwang, Seoul (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/141,617

(22) Filed: Jan. 5, 2021

(65) Prior Publication Data

US 2021/0245925 A1 Aug. 12, 2021

(30) Foreign Application Priority Data

Feb. 11, 2020 (KR) ..... 10-2020-0016343

(51) Int. Cl.
*B65D 25/10* (2006.01)
*B65D 85/68* (2006.01)

(52) U.S. Cl.
CPC ..... *B65D 25/108* (2013.01); *B65D 85/68* (2013.01); *B65D 2585/6835* (2013.01)

(58) Field of Classification Search
CPC ..... B65D 1/36; B65D 25/10; B65D 25/108; B65D 85/48; B65D 85/50; B65D 85/68; B65D 2585/6835; H01L 21/673; H01L 21/67383
USPC ..... 206/564, 722
See application file for complete search history.

(56) References Cited

U.S. PATENT DOCUMENTS 3,768,639 A * 10/1973 Dogliotti ..... B65D 5/503 206/765
3,838,806 A * 10/1974 Dogliotti ..... A47F 7/02 229/120.07
4,207,979 A * 6/1980 Brown ..... G03B 21/64 206/456
4,832,208 A * 5/1989 Finnegan ..... A47F 5/005 206/564
9,054,143 B2 * 6/2015 Ernstberger ..... H01L 21/67383

FOREIGN PATENT DOCUMENTS

EP 0255864 A2 * 2/1988 ..... B65D 1/36
JP 200119074 A * 1/2001 ..... B65D 85/50
JP 201994092 A * 6/2019 ..... B65D 85/50
KR 1020050105598 A 11/2005

(Continued)

*Primary Examiner* — Bryon P Gehman
(74) *Attorney, Agent, or Firm* — Cantor Colburn LLP

(57) ABSTRACT

A tray for a display apparatus includes a plate disposed to be parallel with a first direction and a second direction perpendicular to the first direction, a first recessed part recessed from the plate in a third direction perpendicular to the first and second directions, a second recessed part recessed from the plate in the third direction and spaced apart from the first recessed part in the second direction, a first inclined surface extending from the first recessed part in a direction opposite to the third direction and inclined at a first angle with respect to the plate, and a second inclined surface extending from the second recessed part in the direction opposite to the third direction, inclined at a second angle with respect to the plate and connected to the first inclined surface.

13 Claims, 7 Drawing Sheets

(56) References Cited

FOREIGN PATENT DOCUMENTS

| | | | |
|---|---|---|---|
| KR | 101979903 | B1 | 5/2019 |
| KR | 1020190066168 | A | 6/2019 |
| KR | 1020190070286 | A | 6/2019 |
| KR | 1020190112230 | A | 10/2019 |

* cited by examiner

TRAY FOR DISPLAY APPARATUS AND METHOD OF TRANSPORTING DISPLAY APPARATUS BY USING THE SAME

This application claims priority to Korean Patent Application No. 10-2020-0016343 filed on Feb. 11, 2020, and all the benefits accruing therefrom under 35 USC § 119, the content of which in its entirety is herein incorporated by reference.

BACKGROUND

1. Field

Embodiments of the invention relates to a tray for a display apparatus and a method of transporting a display apparatus by using the tray for a display apparatus, and more particularly, to a tray for a display apparatus with improved workability and a method of transporting a display apparatus by using the tray for a display apparatus.

2. Description of the Related Art

Recently, as the technology improves, display products having smaller sizes, lighter weights, and higher performance have been produced. Conventional cathode ray tube ("CRT") televisions have been widely used for display apparatuses due to desired features such as performance and price. Recently, however, a flat display apparatus such as a plasma display apparatus, a liquid crystal display apparatus, and an organic light emitting diode display apparatus has been spotlighted due to various desired features such as miniaturization, light weight, and low power consumption.

Such a display apparatus may include a portion configured to display an image and covered by a cover window, and a flexible circuit part extending outward of the cover window.

SUMMARY

Display apparatuses such as the organic light emitting diode display apparatus may be placed and transported in a tray having multiple stages for product distribution. During such a transportation, a component of the display apparatus, especially the flexible circuit part, may be damaged due to an external impact or inexperience of a worker in a process of loading and unloading the display apparatus onto and from the tray.

Embodiments provide a tray for a display apparatus with improved workability.

Embodiments provide a method of transporting a display apparatus by using the tray.

According to an embodiment, a tray for a display apparatus includes a plate disposed to be parallel with a first direction and a second direction perpendicular to the first direction, a first recessed part recessed from the plate in a third direction perpendicular to the first and second directions, a second recessed part recessed from the plate in the third direction and spaced apart from the first recessed part in the second direction, a first inclined surface extending from the first recessed part in a direction opposite to the third direction and inclined at a first angle with respect to the plate, and a second inclined surface extending from the second recessed part in the direction opposite to the third direction, inclined at a second angle with respect to the plate and connected to the first inclined surface.

In an embodiment, each of the first angle and the second angle may be greater than about 0 degree and less than about 90 degrees.

In an embodiment, the first inclined surface and the second inclined surface may form a third angle. In such an embodiment, the third angle may be greater than or equal to about 90 degrees and less than about 180 degrees.

In an embodiment, the first inclined surface may include a first protrusion connected to the second inclined surface, and a second protrusion adjacent to the first recessed part.

In an embodiment, the first inclined surface may further include a third protrusion and a fourth protrusion spaced apart from each other in the first direction.

In an embodiment, the display apparatus may include a display panel, and a circuit part including a flexible circuit part connected to the display panel. In such an embodiment, the display panel of the display apparatus may be located on the first inclined surface, and the circuit part of the display apparatus may be located on the second inclined surface.

In an embodiment, the display panel may include a main display area having a rectangular shape, and first to fourth edge display areas connected to four sides of the main display area and curved to be inclined at a predetermined angle with respect to the main display area In an embodiment, a seating groove may be defined between the first inclined surface and the second inclined surface.

According to an embodiment, a tray for a display apparatus includes: a plate disposed to be parallel with a first direction and a second direction perpendicular to the first direction; a first inclined surface inclined at a first angle with respect to the plate; and a second inclined surface inclined at a second angle with respect to the plate, and connected to the first inclined surface. In such an embodiment, a first portion of the first inclined surface, which meets the second inclined surface, is lower than a second portion of the first inclined surface, which is opposite to the first portion.

In an embodiment, a seating groove may be defined between the first inclined surface and the second inclined surface.

In an embodiment, the tray may further include a first recessed part recessed from the plate in a third direction perpendicular to the first and second directions, and second recessed part recessed from the plate in the third direction and spaced apart from the first recessed part in the second direction. In such an embodiment, the first recessed part may be connected to the first inclined surface, and the second recessed part may be connected to the second inclined surface.

In an embodiment, the first inclined surface and the second inclined surface may form a third angle. In such an embodiment, the third angle may be greater than or equal to about 90 degrees and less than about 180 degrees.

In an embodiment, the first inclined surface may include a first protrusion connected to the second inclined surface, and a second protrusion adjacent to the first recessed part.

In an embodiment, the display apparatus may further include a display panel, and a circuit part including a flexible circuit part connected to the display panel. In such an embodiment, the display panel of the display apparatus may be located on the first inclined surface, and the circuit part of the display apparatus may be located on the second inclined surface.

In an embodiment, the display apparatus may further include a cover window disposed on the display panel. In such an embodiment, the display apparatus may be located such that the cover window faces the first inclined surface.

According to an embodiment, a method of transporting a display apparatus includes seating the display apparatus on first and second inclined surfaces of a tray, where the tray includes a plate disposed on a parallel with a first direction and a second direction perpendicular to the first direction, the first inclined surface inclined at a first angle with respect to the plate, and the second inclined surface inclined at a second angle with respect to the plate and connected to the first inclined surface, moving the tray on which with the display apparatus is seated, and unlading the display apparatus from the tray.

In an embodiment, the tray may further include a first recessed part recessed from the plate in a third direction perpendicular to the first and second directions, and a second recessed part recessed from the plate in the third direction and spaced apart from the first recessed part in the second direction. In such an embodiment, the first inclined surface may extend from the first recessed part in a direction opposite to the third direction, and the second inclined surface may extend from the second recessed part in the direction opposite to the third direction In an embodiment, the display apparatus may include a display panel, and a circuit part including a flexible circuit part connected to the display panel. In such an embodiment, when the tray is moved, an end of the display panel may be located within the first recessed part and spaced apart from a bottom of the first recessed part by a predetermined distance, and an end of the circuit part may be located within the second recessed part and spaced apart from a bottom of the second recessed part by a predetermined distance.

In an embodiment, each of the first angle and the second angle may be greater than about 0 degree and less than about 90 degrees. In such an embodiment, the first inclined surface and the second inclined surface may form a third angle, and the third angle may be greater than or equal to about 90 degrees and less than about 180 degrees.

In an embodiment, the display apparatus may include a display panel, and a circuit part including a flexible circuit part connected to the display panel. In such an embodiment, when the display apparatus is seated on the tray, the display panel of the display apparatus is located on the first inclined surface, and the circuit part of the display apparatus is located on the second inclined surface.

In an embodiment, the display panel may include a main display area having a rectangular shape, and first to fourth edge display areas connected to four sides of the main display area and curved to be inclined at a predetermined angle with respect to the main display area.

According to embodiments, a tray for a display apparatus includes a plate disposed to be parallel with a first direction and a second direction perpendicular to the first direction, a first recessed part recessed from the plate in a third direction perpendicular to the first and second directions, a second recessed part recessed from the plate in the third direction and spaced apart from the first recessed part in the second direction, a first inclined surface extending from the first recessed part in a direction opposite to the third direction and inclined at a first angle with respect to the plate, and a second inclined surface extending from the second recessed part in the direction opposite to the third direction, inclined at a second angle with respect to the plate and connected to the first inclined surface.

In such embodiment, when the tray for the display apparatus is used, the display apparatus is safely received, while a volume of the tray for the display apparatus may be reduced, and handling may be performed more efficiently.

BRIEF DESCRIPTION OF THE DRAWINGS

The above and other features of the invention will become more apparent by describing in further detail embodiments thereof with reference to the accompanying drawings, in which.

DETAILED DESCRIPTION

Figure 1:
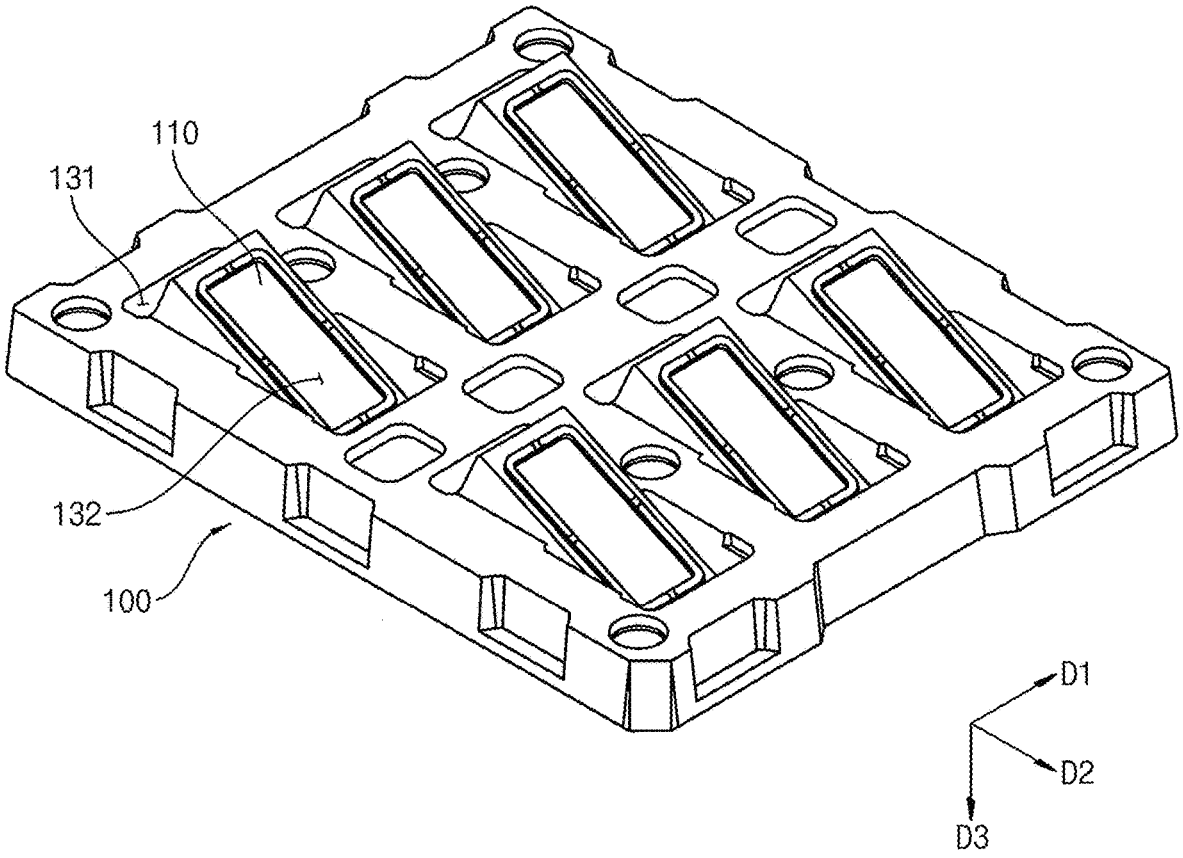
FIG. 1 is a perspective view showing a tray for a display apparatus according to an embodiment of the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, "a", "an," "the," and "at least one" do not denote a limitation of quantity, and are intended to include both the singular and plural, unless the context clearly indicates otherwise. For example, "an element" has the same meaning as "at least one element," unless the context clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10% or 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, embodiments of the invention will be described in more detail with reference to the accompanying drawings.

Figure 2:
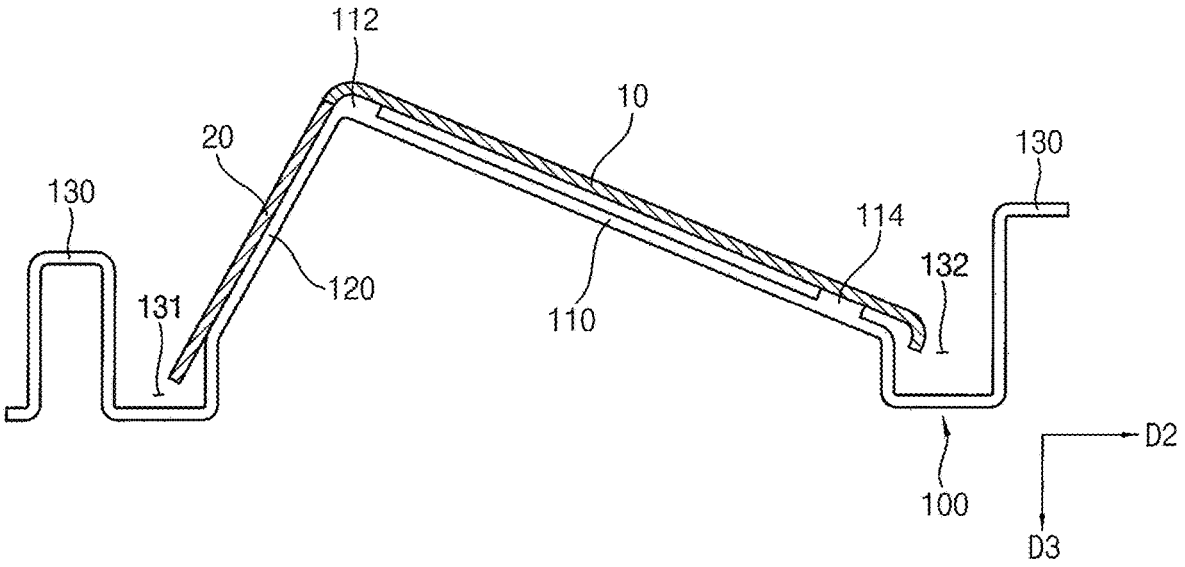
FIG. 2 is a cross-sectional view showing the tray for the display apparatus of FIG. 1 taken along a second direction.
Figure 3:
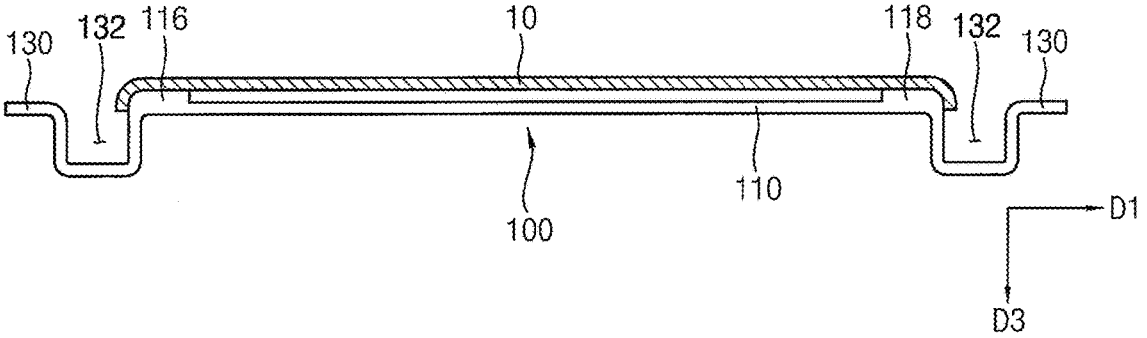
FIG. 3 is a cross-sectional view showing the tray for the display apparatus of FIG. 1 taken along a first direction.

FIG. 1 is a perspective view showing a tray for a display apparatus according to one embodiment of the invention. FIG. 2 is a cross-sectional view showing the tray for the display apparatus of FIG. 1 taken along a second direction. FIG. 3 is a cross-sectional view showing the tray for the display apparatus of FIG. 1 taken along a first direction.

Referring to FIGS. 1 to 3, an embodiment of a tray 100 for a display apparatus may include a plate 130, a first inclined surface (or a first inclined part) 110, a second inclined surface (or a second surface part) 120, a first recessed part 132, and a second recessed part 131.

The plate 130 may be disposed to be parallel with a first direction D1 and a second direction D2 perpendicular to the first direction D1.

The first recessed part 132 may be recessed from the plate 130 in a third direction D3 perpendicular to the first and second directions D1 and D2.

The second recessed part 131 may be recessed from the plate 130 in the third direction D3 and spaced apart from the first recessed part 132 in the second direction D2.

The first inclined surface 110 may be a surface on which a display panel 10 of the display apparatus is disposed, and may extend from the first recessed part 132 in a direction opposite to the third direction D3. The first inclined surface 110 may be inclined at a first angle θ1 with respect to the plate 130. The first angle θ1 may be greater than about 0 degree and less than about 90 degrees.

The first inclined surface 110 may include a first protrusion 112 connected to the second inclined surface 120. The first inclined surface 110 may include a second protrusion 114 adjacent to the first recessed part 132. The first and second protrusions 112 and 114 may allow a space to form between the display apparatus and the first inclined surface 110, so that the display apparatus may be effectively prevented from being damaged by undesirable foreign substances between the display apparatus and the first inclined surface 110.

The first inclined surface 110 may further include a third protrusion 116 and a fourth protrusion 118 spaced apart from each other in the first direction D1. The third and fourth protrusions 116 and 118 may correspond to both edge display areas of the display apparatus in the first direction D1 to restrict a fluctuation of the display apparatus in the first direction D1.

The second inclined surface 120 may be a surface on which a circuit part 20 of the display apparatus is disposed, and may extend from the second recessed part 131 in the direction opposite to the third direction D3. The second inclined surface 120 may be inclined at a second angle θ2 with respect to the plate 130, and may be connected to the first inclined surface 110. The second angle θ2 may be greater than about 0 degree and less than about 90 degrees.

In an embodiment, the first inclined surface 110 and the second inclined surface 120 may form a third angle θ3. The third angle θ3 may be greater than or equal to about 90 degrees and less than about 180 degrees. The third angle θ3 may vary or determined based on an angle between the display panel 10 and the circuit part 20 of the display apparatus.

When the display panel 10 and the circuit part 20 of the display apparatus are located on the first inclined surface 110 and the second inclined surface 120, respectively, an end of the display panel 10 may be located within the first recessed part 132 and spaced apart from a bottom portion of the first recessed part 132 by a predetermined distance, and an end of the circuit part 20 may be located within the second recessed part 131 and spaced apart from a bottom portion of the second recessed part 131 by a predetermined distance.

The tray for the display apparatus may be manufactured through injection molding by using a material such as plastic, but the embodiments are not limited thereto. In such an embodiment, the tray for the display apparatus may include at least one selected from various known materials in the art, and may be formed by at least one selected from various known schemes in the art.

In an embodiment, as shown in FIG. 1, the tray 100 for the display apparatus may have a plurality of reception parts arranged in the first direction D1 and the second direction D2, in which each of the reception parts is formed by the first inclined surface 110 and the second inclined surface 120, and a plurality of display apparatuses may be simultaneously received in the reception parts.

The display apparatus may include a display panel 10 and a circuit part 20. The circuit part 20 may be connected to the display panel 10 to be inclined at a predetermined angle with respect to the display panel 10. The display apparatus will be described in greater detail below with reference to FIGS. 4 and 5.

In an embodiment, various types of display apparatuses including a first substrate, a second substrate, and a light emitting element may be used as the display apparatus. The display apparatus may be a panel of an organic light emitting diode display apparatus, but is not limited thereto. In one alternative embodiment, for example, the display apparatus may be a liquid crystal display apparatus, a plasma display apparatus, a field emission display apparatus, or the like other than the organic light emitting diode display apparatus.

Figure 4:
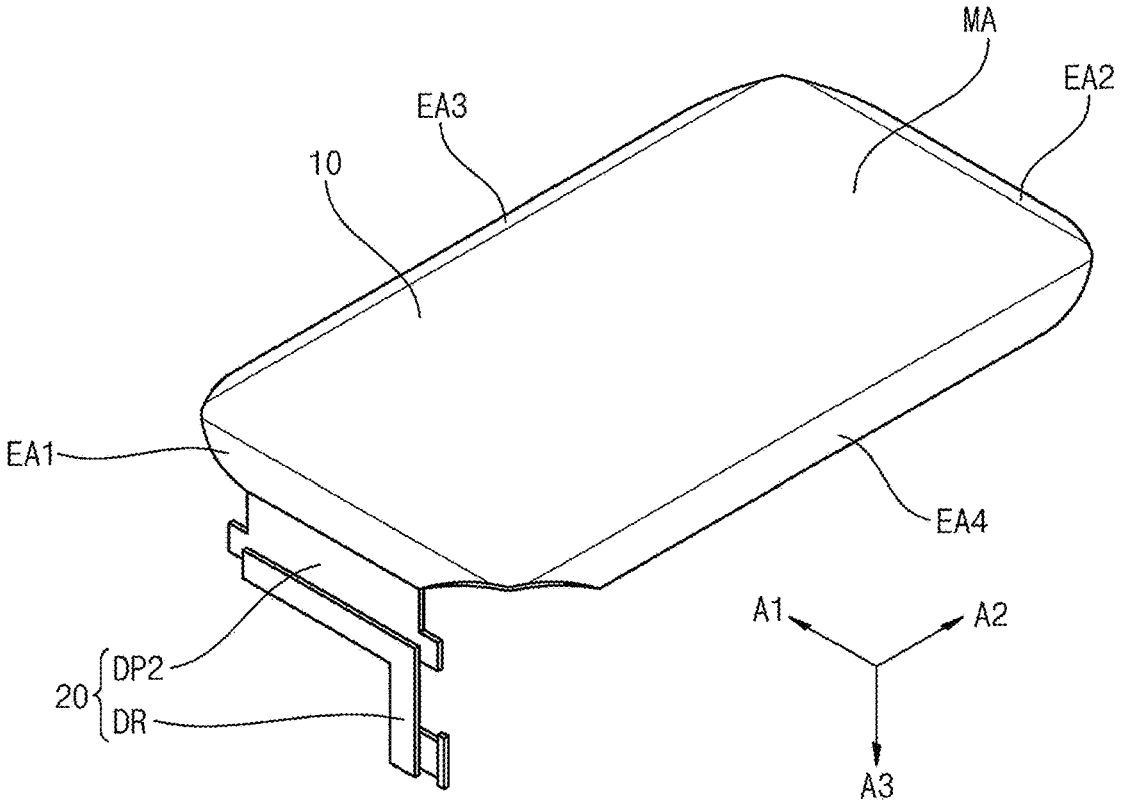
FIG. 4 is a perspective view showing an embodiment of a display apparatus transported by the tray for the display apparatus of FIGS. 1 to 3.
Figure 5:
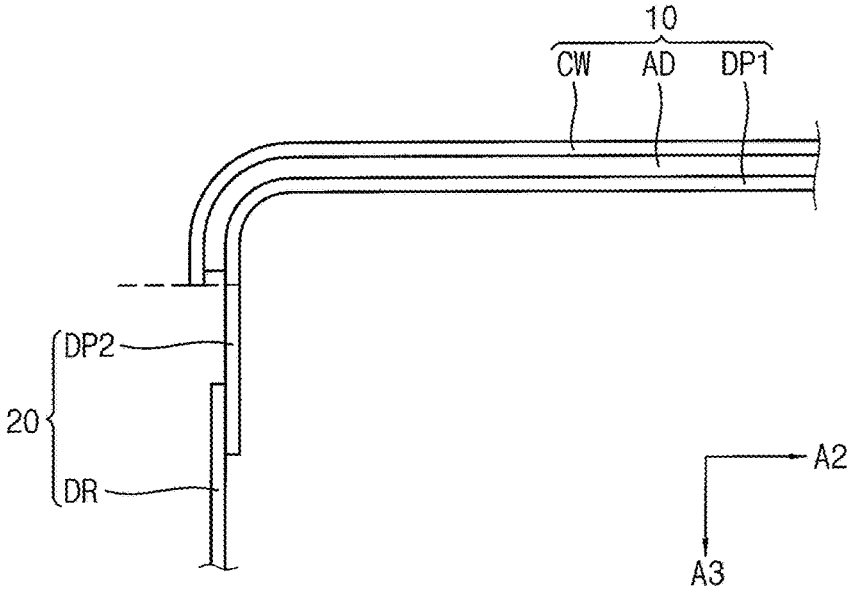
FIG. 5 is a partial cross-sectional view showing the display apparatus of FIG. 4.

FIG. 4 is a perspective view showing an embodiment of a display apparatus transported by the tray for the display apparatus of FIGS. 1 to 3. FIG. 5 is a partial cross-sectional view showing the display apparatus of FIG. 4.

Referring to FIG. 4, an embodiment of a display apparatus may include a display panel 10, and a circuit part 20 connected to the display panel 10.

The circuit part 20 may include a circuit board part DR and a flexible circuit part DP2.

The display panel 10 may include a flexible substrate DP1 on which a pixel structure is disposed, an adhesive layer AD, and a cover window CW.

The flexible substrate DP1 may include or be formed of a transparent or opaque material. In one embodiment, for example, the flexible substrate DP1 may be a transparent resin substrate having flexibility. In such an embodiment, the transparent resin substrate includes a polyimide substrate, for example. In an alternative embodiment, the flexible substrate DP1 may include a quartz substrate, a synthetic quartz substrate, a calcium fluoride substrate, a fluorine-doped quartz substrate (F-doped quartz substrate), a soda lime glass substrate, a non-alkali glass substrate, or the like.

The pixel structure may be disposed or formed on the flexible substrate DP1. In one embodiment, for example, a thin film transistor and a pixel structure electrically connected to the thin film transistor may be included in the display panel 10. The pixel structure may include a first electrode, an organic light emitting layer, and a second electrode. Meanwhile, the pixel structure may have one of various known forms, so the detailed descriptions thereof will be omitted.

The adhesive layer AD may be disposed between the flexible substrate DP1 and the cover window CW. The adhesive layer AD may attach the flexible substrate DP1 to the cover window CW. The adhesive layer AD may include, for example, a pressure-sensitive adhesive layer.

In an electronic device (e.g., a smartphone) including the display apparatus, the cover window CW may constitute a part of an outer surface of the electronic device.

The display panel 10 may include: a main display area MA for displaying an image; and a first edge display area EA1, a second edge display area EA2, a third edge display area EA3, and a fourth edge display area EA4 that are connected to the main display area MA.

The main display area MA may have a rectangular shape extending in a transverse direction A1 and a longitudinal direction A2.

The first edge display area EA1 may be connected to one side of the main display area MA, and may be curved to be inclined at a predetermined angle with respect to the main display area MA. In one embodiment, for example, the first edge display area EA1 may be curved such that an end portion of the first edge display area EA1 extends in a vertical direction A3 perpendicular to the main display area MA.

The second edge display area EA2 may be formed at a position opposite to the first edge display area EA1, and may be curved to be inclined at a predetermined angle with respect to the main display area MA similarly to the first edge display area EA1. In such an embodiment, the third and fourth edge display areas EA3 and EA4 may be curved as described above with respect to the first edge display area EA1, so the detailed descriptions thereof will be omitted.

The display apparatus may further include a non-display area (not shown) surrounding the main display area MA and the first to fourth edge display areas EA1, EA2, EA3, and EA4.

The circuit part 20 may be connected to the end of the first edge display area EA1.

The circuit board part DR may include wires and a driving circuit for driving the display panel 10. The circuit board part DR may include a flexible circuit board and the like.

The flexible circuit part DP2 may be disposed between the circuit board part DR and the display panel 10 to electrically connect the circuit board part DR and the display panel 10 to each other. The flexible circuit part DP2 may include a flexible substrate having flexibility, and may be, for example, integrally formed with the flexible substrate DP1 as a single unitary unit.

The first edge display area EA1 of the display apparatus may have an inclination close to 90 degrees with respect to the main display area MA. Accordingly, the circuit part 20 may be perpendicular to the display panel 10. Since the circuit part 20 is perpendicular to the display panel 10, the circuit part 20 may be damaged while the display apparatus is transported.

In an embodiment, when a tray for receiving the circuit part 20 is manufactured, a volume of the tray may be increased due to a height of the circuit part 20 in the vertical direction A3.

In an embodiment, the tray for the display apparatus of FIGS. 1 to 3 is used, such that the display apparatus is safely received, while a volume of the tray for the display apparatus may be reduced, and handling may be performed more efficiently.

Figure 6:
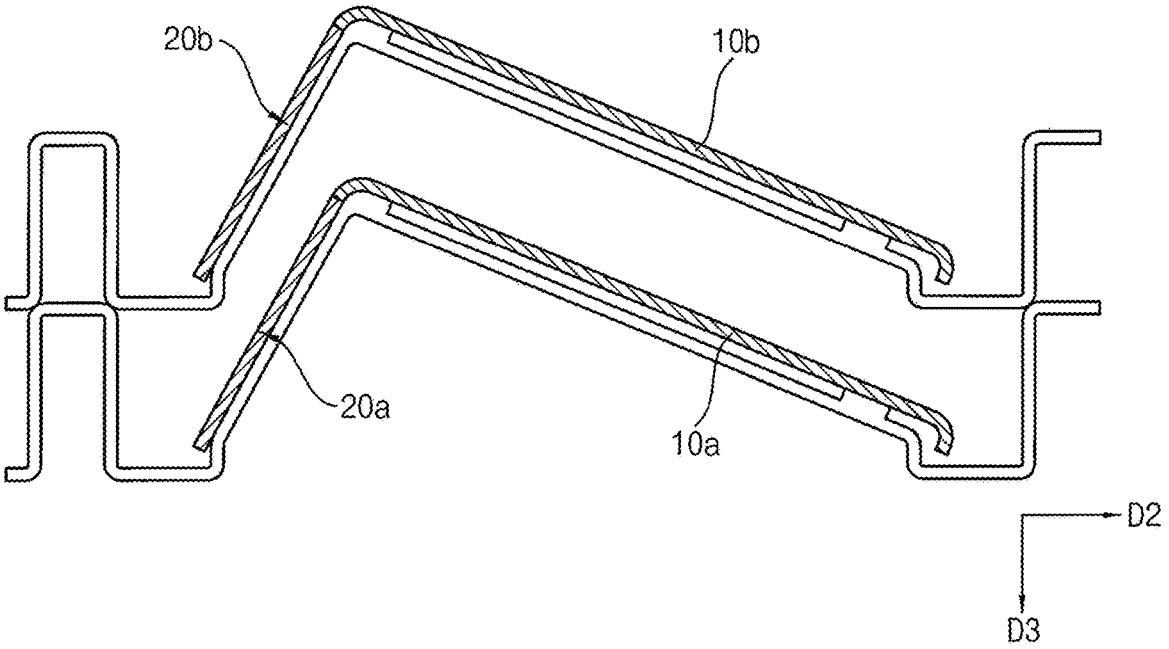
FIG. 6 is a cross-sectional view showing a state in which a plurality of trays for a display apparatus are stacked according to an embodiment of the invention.

FIG. 6 is a cross-sectional view showing a state in which a plurality of trays for a display apparatus are stacked according to an embodiment of the invention.

Referring to FIG. 6, a first tray 100*a* and a second tray 100*b* may be stacked one on another in a vertical direction, in which a first display apparatus including a first display panel 10*a* and a first circuit part 20*a* may be received on first and second inclined surfaces of the first tray 100*a*, and a second display apparatus including a second display panel 10*b* and a second circuit part 20*b* may be received on first and second inclined surfaces of the second tray 100*b*. The first and second inclined surfaces of each of the first tray 100*a* and the second tray 100*b* may be inclined at a predetermined angle, so that the first and second display apparatuses may be safely received while being received within a small volume.

Figure 7:
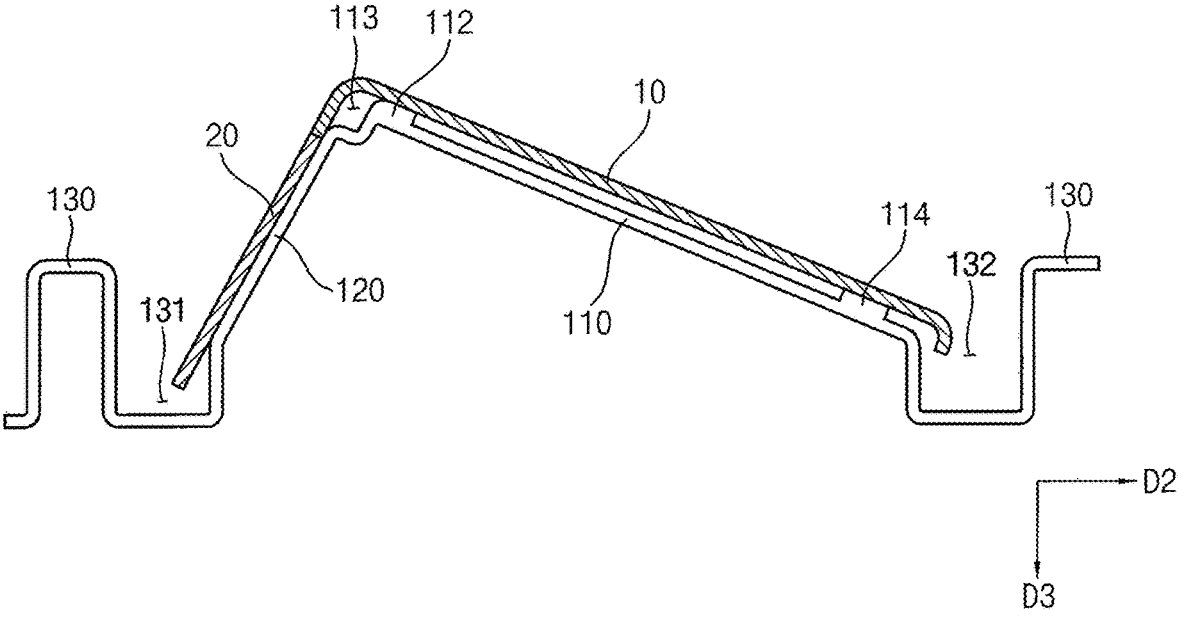
FIG. 7 is a cross-sectional view showing a tray for a display apparatus according to an alternative embodiment of the invention.

FIG. 7 is a cross-sectional view showing a tray for a display apparatus according to an alternative embodiment of the invention.

Referring to FIG. 7, a tray for a display apparatus is substantially the same as the tray for the display apparatus of FIGS. 1 to 3 except that a seating groove 113 is formed at a portion where the first inclined surface 110 and the second inclined surface 120 meet each other. The same or like elements shown in FIG. 7 have been labeled with the same reference characters as used above to describe the embodiments of the tray for the display apparatus of FIGS. 1 to 3, and any repetitive detailed description thereof will hereinafter be omitted or simplified.

In such an embodiment, as shown in FIG. 7, a space may be formed between the display apparatus and the tray for the display apparatus by the seating groove 113, so that the display apparatus may be stably received in the tray for the display apparatus, and simultaneously, a direct impact may be prevented from being applied to a connection portion between the display panel 10 and the circuit part 20 of the display apparatus. Accordingly, the display apparatus is safely received, while the volume of the tray for the display apparatus may be reduced, and the handling may be performed more efficiently.

Figure 8:
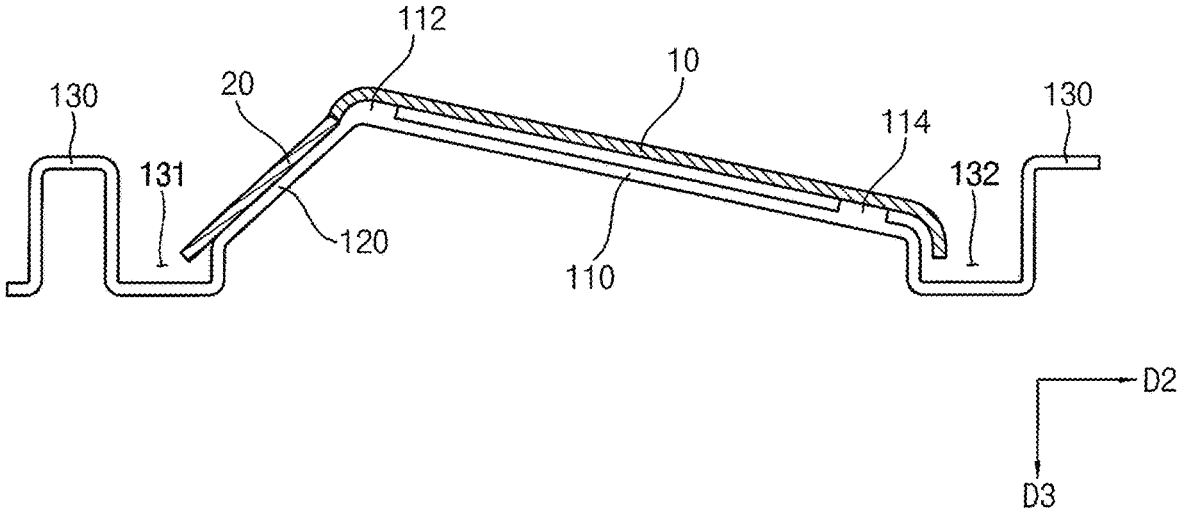
FIG. 8 is a cross-sectional view showing a tray for a display apparatus according to another alternative embodiment of the invention.

FIG. 8 is a cross-sectional view showing a tray for a display apparatus according to another alternative embodiment of the invention.

Referring to FIG. 8, a tray for a display apparatus is substantially the same as the tray for the display apparatus of FIGS. 1 to 3 except that the third angle between the first inclined surface 110 and the second inclined surface 120 is greater than 90 degrees and less than 180 degrees. The same or like elements shown in FIG. 8 have been labeled with the same reference characters as used above to describe the embodiments of the tray for the display apparatus of FIGS. 1 to 3, and any repetitive detailed description thereof will hereinafter be omitted or simplified.

Figure 9A:
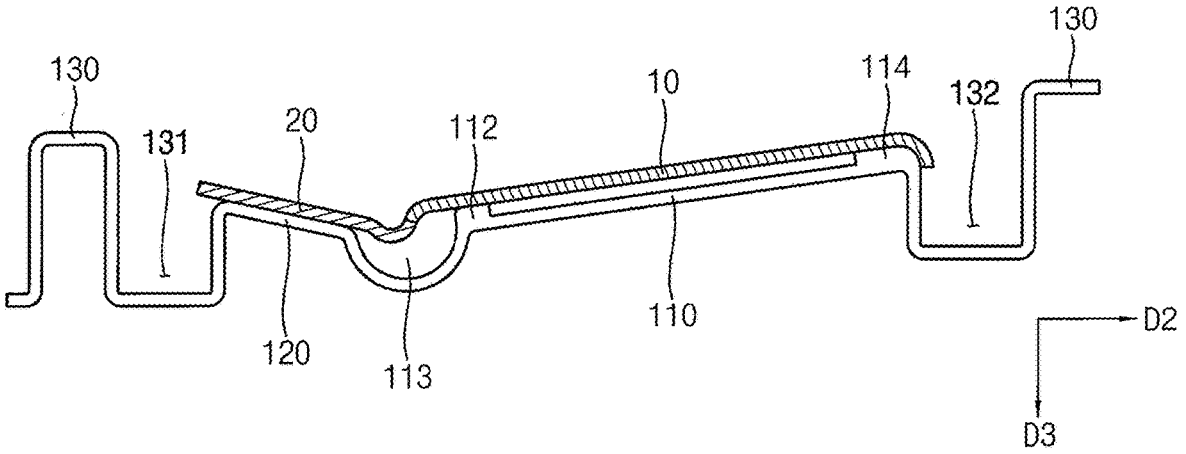
FIGS. 9A and 9B are cross-sectional views showing a tray for a display apparatus according to other alternative embodiments of the invention.

FIG. 9A is a cross-sectional view showing a tray for a display apparatus according to another alternative embodiment of the invention.

Referring to FIG. 9A, a tray for a display apparatus is substantially the same as the tray for the display apparatus of FIG. 7 except for an inclination angle between the first inclined surface 110 and the second inclined surface 120. The same or like elements shown in FIG. 9A7 have been labeled with the same reference characters as used above to describe the embodiments of the tray for the display apparatus of FIG. 7, and any repetitive detailed description thereof will hereinafter be omitted or simplified.

In an embodiment, as shown in FIG. 9A, the tray for the display apparatus may include: a plate 130 disposed to be parallel with a first direction D1 and a second direction D2 perpendicular to the first direction D1; a first inclined surface 110 inclined at a first angle with respect to the plate 130; a second inclined surface 120 inclined at a second angle with respect to the plate 130, and connected to the first inclined surface 110; a first recessed part 132 recessed from the plate 130 in a third direction D3 perpendicular to the first and second directions D1 and D2; and a second recessed part 131 recessed from the plate 130 in the third direction D3 and spaced apart from the first recessed part 132 in the second direction D2.

A first portion of the first inclined surface 110, which meets the second inclined surface 120, may be lower than a second portion of the first inclined surface 110, which is opposite to the first portion.

The first inclined surface 110 may include a first protrusion 112, and a second protrusion 114 opposite to the first protrusion 112. The first inclined surface 110 and the second inclined surface 120 may form a third angle, and the third angle may be greater than 90 degrees and less than 180 degrees. A seating groove 113 may be defined between the first inclined surface 110 and the second inclined surface 120 or formed at the portion where the first inclined surface 110 and the second inclined surface 120 meet each other. In such an embodiment, the first protrusion 112 may be connected to the seating groove 113, and the second protrusion 114 may be adjacent to the first recessed part 132.

The display apparatus may include: a display panel 10; and a circuit part 20 including a flexible circuit part connected to the display panel 10.

The display panel 10 of the display apparatus may be located on the first inclined surface 110, and the circuit part 20 of the display apparatus may be located on the second inclined surface 120.

Figure 9B:
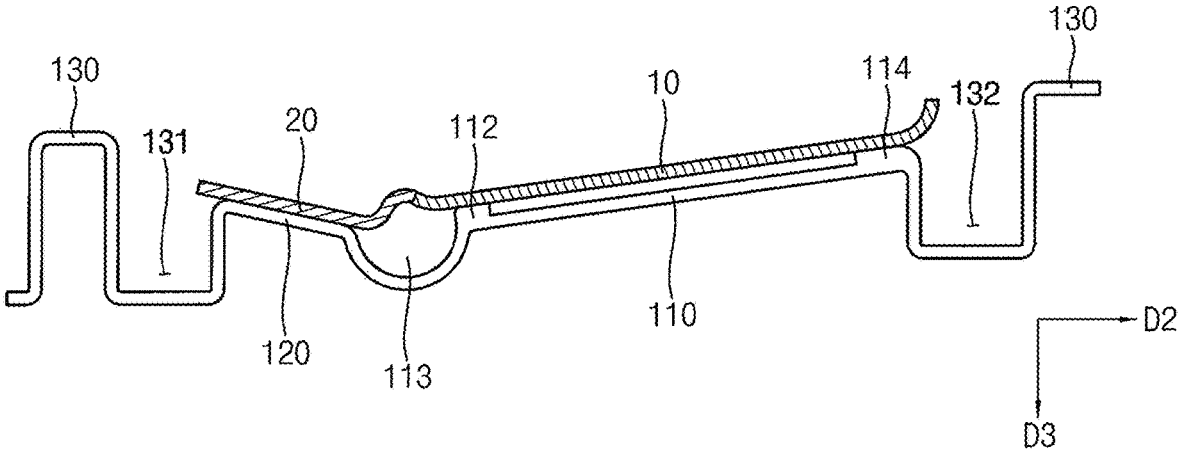

FIG. 9B is a cross-sectional view showing the tray for the display apparatus according to another alternative embodiment of the invention.

Referring to FIG. 9*b*, the tray for the display apparatus is substantially the same as the tray for the display apparatus of FIG. 9A except that a bottom side of the display apparatus is turned over. The same or like elements shown in FIG. 9B have been labeled with the same reference characters as used above to describe the embodiments of the tray for the display apparatus of FIG. 9A, and any repetitive detailed description thereof will hereinafter be omitted or simplified.

The display apparatus may further include a cover window disposed on the display panel 10, and the display apparatus may be located such that the cover window faces the first inclined surface 110.

Figure 10:
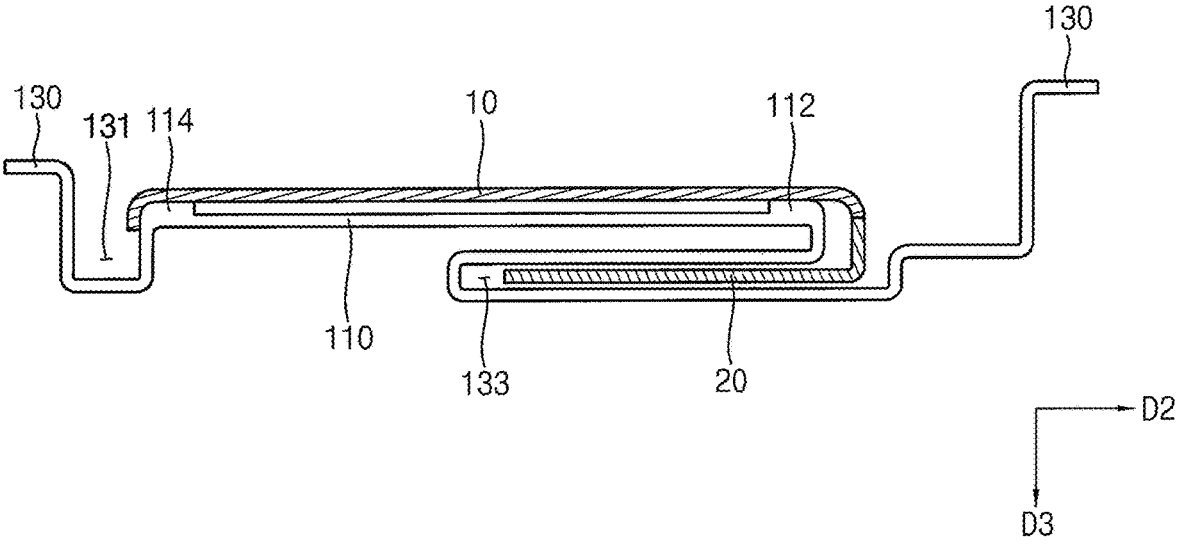
FIG. 10 is a cross-sectional view showing a tray for a display apparatus according to another alternative embodiment of the invention.

FIG. 10 is a cross-sectional view showing a tray for a display apparatus according to another alternative embodiment of the invention.

Referring to FIG. 10, an embodiment of a tray for a display apparatus may include: a plate 130 disposed to be parallel with a first direction D1 and a second direction D2 perpendicular to the first direction D1; a first surface 110 on which a display panel 10 of the display apparatus is located; a pocket part 133 in which a circuit part 20 of the display apparatus is located; and a second recessed part 131 recessed from the plate 130 in a third direction D3 perpendicular to the first and second directions D1 and D2.

The pocket part 133 may be disposed under the first surface 110, and the circuit part 20 may be bent from the display panel 10 to be received in the pocket part 133.

Accordingly, when the tray for the display apparatus is used, the display apparatus is safely received, while the volume of the tray for the display apparatus may be reduced, and the handling may be performed more efficiently.

Figure 11:
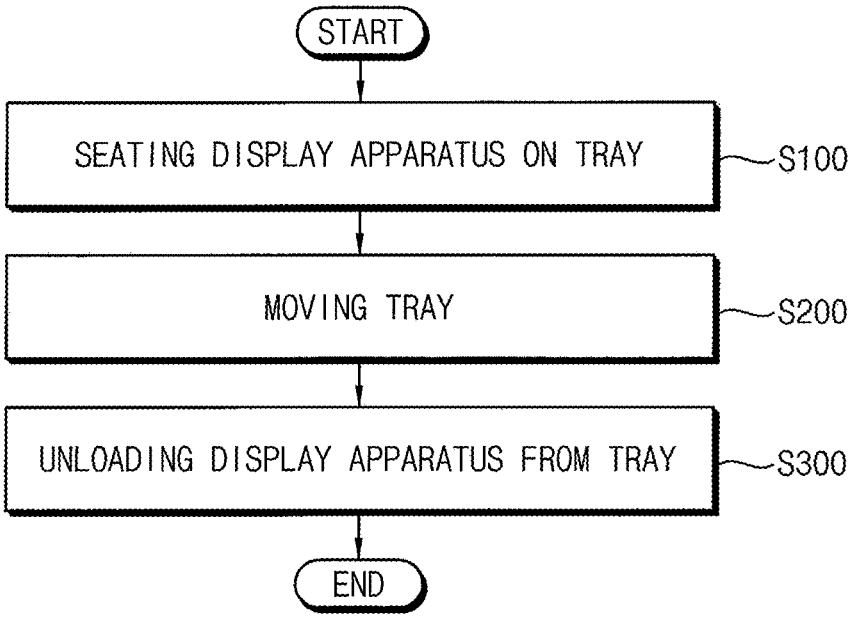
FIG. 11 is a flowchart showing a method of transporting a display apparatus according to an embodiment of the invention.

FIG. 11 is a flowchart showing a method of transporting a display apparatus according to an embodiment of the invention.

Referring to FIG. 11, an embodiment of a method of transporting a display apparatus may include: seating the display apparatus on a tray (S100); moving the tray (S200); and unloading the display apparatus from the tray (S300).

In the seating of the display apparatus on the tray (S100), the display apparatus may be seated on first and second inclined surfaces of the tray for the display apparatus, in which the tray includes a plate disposed to be parallel with a first direction and a second direction perpendicular to the first direction, the first inclined surface inclined at a first angle with respect to the plate, and the second inclined surface inclined at a second angle with respect to the plate and connected to the first inclined surface In the moving of the tray (S200), the tray on which the display apparatus is seated may be moved.

In the unloading of the display apparatus from the tray (S300), the display apparatus may be unloaded from the tray.

In such an embodiment, an embodiment of a tray for a display apparatus according to the invention may be used as the tray, so that the display apparatus is safely received, while the volume of the tray for the display apparatus may be reduced, and the handling may be performed more efficiently.

Embodiments may be applied to a method for manufacturing a display apparatus. The display apparatus may be applied to a mobile phone, a smart phone, a video phone, a smart watch, a table personal computer ("PC"), a navigator for a vehicle, a television, a computer monitor, a notebook computer, a head-mount display or the like.

The invention should not be construed as being limited to the embodiments set forth herein. Rather, these embodiments are provided so that this disclosure will be thorough and complete and will fully convey the concept of the invention to those skilled in the art.

While the invention has been particularly shown and described with reference to embodiments thereof, it will be understood by those of ordinary skill in the art that various changes in form and details may be made therein without departing from the spirit or scope of the invention as defined by the following claims.

What is claimed is:

1. A tray for a display apparatus, the tray comprising:

a plate disposed to be parallel with a first direction and a second direction perpendicular to the first direction;

a first recessed part recessed from the plate in a third direction perpendicular to the first and second directions;

a second recessed part recessed from the plate in the third direction and spaced apart from the first recessed part in the second direction;

a first inclined surface extending from the first recessed part in a direction opposite to the third direction, and inclined at a first angle with respect to the plate; and a second inclined surface extending from the second recessed part in the direction opposite to the third direction, inclined at a second angle with respect to the plate, and connected to the first inclined surface, wherein the first inclined surface includes a first protrusion connected to the second inclined surface, and a second protrusion adjacent to the first recessed part, and the first and second protrusions are protruded in a way such that a space is formed between the display apparatus and the first inclined surface.

2. The tray of claim 1, wherein each of the first angle and the second angle is greater than about 0 degree and less than about 90 degrees.

3. The tray of claim 2, wherein the first inclined surface and the second inclined surface form a third angle, and the third angle is greater than or equal to about 90 degrees and less than about 180 degrees.

4. The tray of claim 1, wherein the first inclined surface further includes a third protrusion and a fourth protrusion spaced apart from each other in the first direction.

5. The tray of claim 1, wherein the display apparatus includes a display panel, and a circuit part including a flexible circuit part connected to the display panel, the display panel of the display apparatus is located on the first inclined surface, and the circuit part of the display apparatus is located on the second inclined surface.

6. The tray of claim 5, wherein the display panel includes:

a main display area having a rectangular shape; and first to fourth edge display areas connected to four sides of the main display area, and curved to be inclined at a predetermined angle with respect to the main display area.

7. The tray of claim 1, wherein a seating groove is defined between the first inclined surface and the second inclined surface.

8. A tray for a display apparatus, the tray comprising:

a plate disposed to be parallel with a first direction and a second direction perpendicular to the first direction;

a first inclined surface inclined at a first angle with respect to the plate; and a second inclined surface inclined at a second angle with respect to the plate, and connected to the first inclined surface, wherein a first portion of the first inclined surface, which meets the second inclined surface, is lower than a second portion of the first inclined surface, which is opposite to the first portion, the first inclined surface includes a first protrusion connected to the second inclined surface, and a second protrusion adjacent to the first recessed part, and the first and second protrusions are protruded in a way such that a space is formed between the display apparatus and the first inclined surface.

9. The tray of claim 8, wherein a seating groove is defined between the first inclined surface and the second inclined surface.

10. The tray of claim 8, further comprising:

a first recessed part recessed from the plate in a third direction perpendicular to the first and second directions; and a second recessed part recessed from the plate in the third direction and spaced apart from the first recessed part in the second direction, wherein the first recessed part is connected to the first inclined surface, and the second recessed part is connected to the second inclined surface.

11. The tray of claim 8, wherein the first inclined surface and the second inclined surface form a third angle, and the third angle is greater than about 90 degrees and less than about 180 degrees.

12. The tray of claim 8, wherein the display apparatus includes a display panel, and a circuit part including a flexible circuit part connected to the display panel, the display panel of the display apparatus is located on the first inclined surface, and the circuit part of the display apparatus is located on the second inclined surface.

13. The tray of claim 12, wherein the display apparatus further includes a cover window disposed on the display panel, and the display apparatus is located such that the cover window faces the first inclined surface.

* * * * *